US006114842A

United States Patent [19]

Simpson et al.

[11] Patent Number: 6,114,842

[45] Date of Patent: Sep. 5, 2000

[54] PRECISION VOLTAGE REGULATOR FOR CAPACITOR-CHARGING POWER SUPPLY

[75] Inventors: Lawrence L. Simpson, Walpole; Adrian C. Delforge, Rockport; Yuri Botnar, Woburn, all of Mass.

[73] Assignee: Kaiser Systems, Inc., Beverly, Mass.

[21] Appl. No.: 09/427,221

[22] Filed: Oct. 26, 1999

[51] Int. Cl.[7] ..... G05F 1/613; G05F 1/40

[52] U.S. Cl. ..... 323/223; 323/265

[58] Field of Search ..... 323/220, 223, 323/234, 265, 282, 285, 349; 320/132, 106, 110; 363/15, 89

[56] References Cited

U.S. PATENT DOCUMENTS

| | | | |
|---|---|---|---|
| 3,781,653 | 12/1973 | Marini | 323/284 |
| 3,982,173 | 9/1976 | Berry et al. | 323/236 |
| 4,020,360 | 4/1977 | Udvardi-Lakos | 307/66 |
| 4,357,572 | 11/1982 | Andersen et al. | 323/286 |
| 5,625,275 | 4/1997 | Tanikawa et al. | 320/32 |
| 5,701,068 | 12/1997 | Baer et al. | 320/119 |
| 6,018,228 | 1/2000 | Dias et al. | 320/106 |
| 6,037,749 | 3/2000 | Parsonage | 320/132 |
| 6,037,750 | 3/2000 | Von Novak | 320/132 |
| 6,043,626 | 3/2000 | Snyder et al. | 320/113 |

*Primary Examiner*—Adolf Deneke Berhane

*Attorney, Agent, or Firm*—Seidel, Gonda, Lavorgna & Monaco, PC

[57] ABSTRACT

A precision voltage regulator is provided for a capacitor-charging power supply. Both the power supply output and the load capacitor are shunted at the same time by a shunt control circuit. The load capacitor shunt is maintained for a period of time determined by the hysteresis of a precision comparator that compares the voltage across the capacitor with a program voltage that has been adjusted for the power supply's instantaneous current. The regulator is particularly applicable to high power applications with a high repetition rates.

10 Claims, 2 Drawing Sheets

Voltage or Current Magnitude
0

Overshoot

Circuit Delay
Δt
t1
time

PRECISION VOLTAGE REGULATOR FOR CAPACITOR-CHARGING POWER SUPPLY

FIELD OF THE INVENTION

The present invention relates to a precision voltage regulator used with a capacitor-charging power supply.

BACKGROUND OF THE INVENTION

High frequency switching power supply designs have inherent limitations that limit the voltage repeatability in a non-quiescent state, such as capacitor charging applications. These limitations include EMI (electromagnetic interference), charge quantization, output current ripple, and program and feedback voltage integrity. Precise voltage regulation of capacitors, on the order of less than 0.05 percent, in a pulse-to-pulse charging mode of operation, which store less than 0.002 percent of the average energy of the power supply, has been difficult to achieve. The ability to stop output current on command is limited to inefficient, non-resonant pulse width modulation switching topologies. If such an approach is used, the high power capability of the power supply inherently creates a tendency to overshoot the objective due to the energy established in real and parasitic inductances within the power supply and in the connecting circuits to the load capacitor. Minimizing the inductance and remote voltage sensing at the load capacitor are not sufficient to reduce the effect to meet the desired precision in voltage regulation and repeatability.

When a resonant topology is used, the ability to stop output production is limited to ending on a resonant cycle, resulting in a quantization of output current into packets that establish the fundamental limit of the minimum size increment of load capacitor voltage. For frequencies less than 200 kHz, the limitations on switching frequency produce a packet size that is too large. The decision to stop charging is accomplished by comparing the programmed voltage to the feedback voltage, which are scaled to the order of ten volts for full output voltage. This scaling results in a 5 mV decision for a voltage resolution of less than 0.05 percent. The dV/dt electrical noise generated by the power converter and the magnetic coupling from the circulating currents (at any output current level) is significantly greater than this 5 mV level.

Although it is possible to remotely send an analog signal with less than 1 mV of noise by filtering it, the requirements of a bandwidth greater than 5 kHz do not allow it. Electrical noise injected during the charging period is integrated by the filter and produces a varying offset voltage.

The voltage regulator in the present invention addresses this problem by delaying the precision voltage comparison decision until after the power conversion has stopped. By intentionally allowing the output to overshoot a prescribed amount, after which time a precision shunt regulator is engaged, the output capacitor voltage is lowered in a substantially linear manner.

SUMMARY OF THE INVENTION

In its broadest aspect, the present invention is a precision voltage regulator that is used with a power supply charging a load capacitor. The first and second terminals of a main shunt device are connected across the first and second outputs of the power supply, respectively. The first terminal of an isolation device, typically a diode, is connected to the first output of the power supply and the first terminal of the main shunt device. A current sensor is connected in series with the first output of the power supply. The current sensor senses the power supply's output current, and outputs a signal proportional to the output current. A precision shunt and load resistor are connected in series across the first and second outputs of the power supply. A voltage sensing circuit is preferably connected in immediate proximity to the load capacitor. A precision differential amplifier has an input from the voltage sensing circuit. A precision comparator with hysteresis has inputs from the differential amplifier and the combination of the power supply's output current and an analog program voltage. The comparator outputs a signal to a shunt control circuit that controls the main shunt and the precision shunt. The shunt control circuit enables the main and precision shunts at the same, but does not disable the precision shunt until the hysteresis for the comparator has been satisfied. The current sensor may be a toroidal transformer electromagnetically coupled to the first output of the power supply, along with circuitry to convert current induced in the transformer into a signal proportional to the output current. The voltage sensor may be composed of two series resistors with an output at the common terminals of the two resistors. The voltage sensor may be connected in close proximity to the terminals of the load capacitor. A digital-to-analog converter can be used to provide the analog program voltage from a digitally inputted program voltage. The digital-to-analog converter may be located in close proximity to the comparator.

In another aspect, the invention is a method of precisely regulating the voltage across a load capacitor connected to a capacitor-charging power supply. The voltage is measured at the load capacitor, and the output current of the power supply is measured. An analog program voltage is established. The voltage measured at the output of the voltage sensor is inputted to a precision differential amplifier. The output of the precision differential amplifier is inputted to a precision comparator with hysteresis. The combination of the established analog program voltage and output current are inputted to the precision comparator. The output of the power supply and the load capacitor are shunted at substantially the same time, while isolating the main shunt of the power supply's output from the load capacitor's shunt. The shunt for the load capacitor is maintained until the hysteresis of the precision comparator has been satisfied. The voltage of the load capacitor can be measured in close proximity to the load capacitor. The analog program voltage can be established by establishing a digital program voltage and converting it into an analog program voltage.

These and other aspects of the invention will be apparent from the following description and the appended claims.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
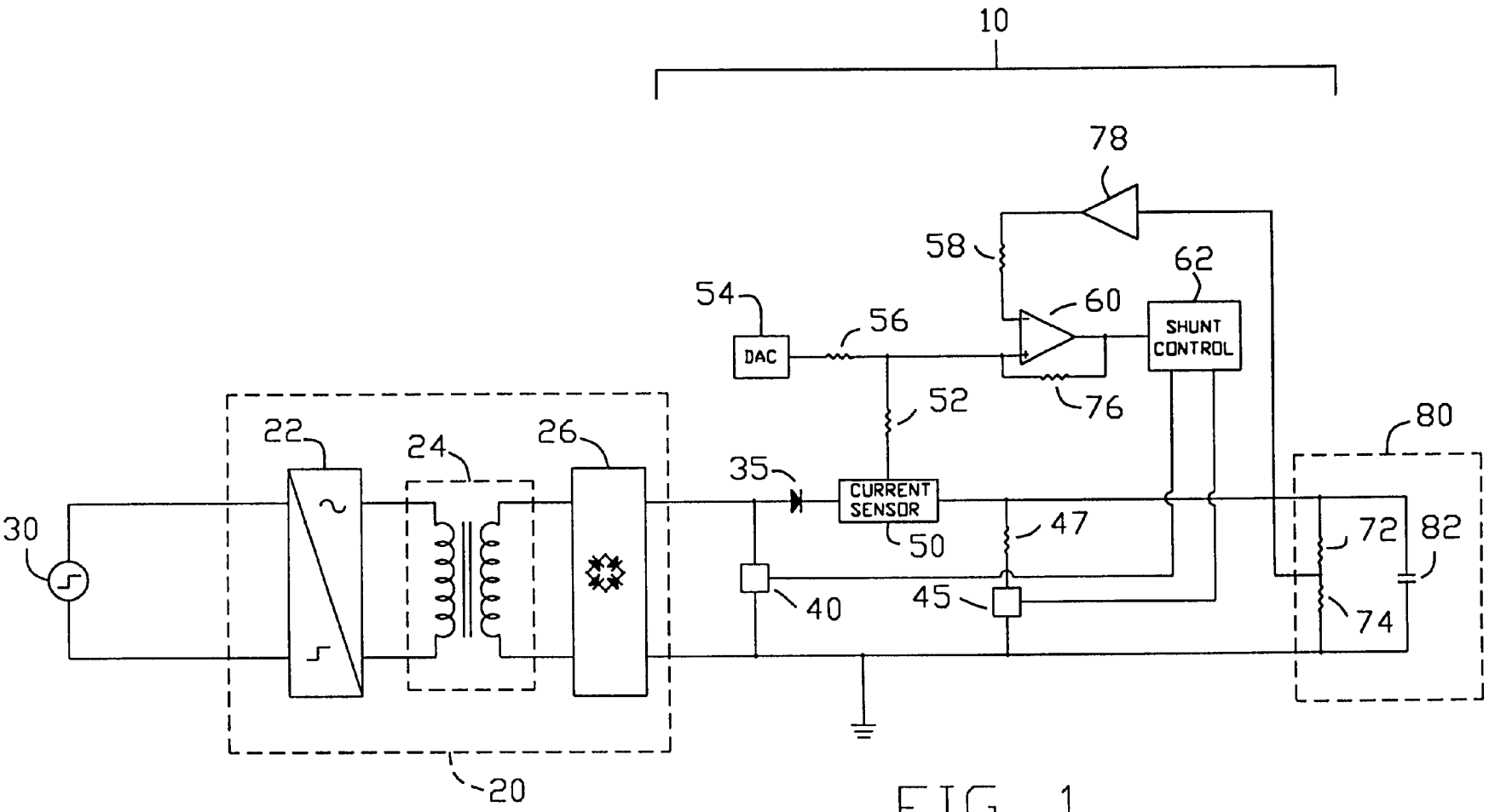
FIG. 1 is a combination circuit schematic and block diagram of a capacitor-charging power supply with the precision voltage regulator of the present invention.

Referring now to the drawings, wherein like numerals indicate like elements, there is shown in FIG. 1, in accordance with the present invention, one embodiment of the precision voltage regulator 10. A resonant converter power supply 20, composed of a switch and resonant tank network 22, transformer 24, and rectifier network 26, supplies power to load capacitor 82. A suitable dc power source 30, known in the art, provides input power to the power supply 20. Components and design of the power supply are also known in the art. Components of the voltage regulator 10 are generally provided in the same physical enclosure as the power supply 20, except for resistors 72 and 74, which form the load voltage sensing device. Main shunt device 40 is connected across the output of the power supply 20 to shunt the power supply's output current in response to a control signal from a shunt control circuit 62. Main shunt device 40 may be a insulated gate bipolar transistor (IGBT) or other suitable electrical switching device known in the art. When the appropriate control signal is sent from the shunt control circuit 62 to the gate of the IGBT main shunt device 40, the IGBT conducts and the power supply's output current is shunted to the second output of the power supply, while the power supply is permitted to complete the resonant cycle. The first output of the power supply and the anode of the IGBT main shunt device 40 are connected to an isolation device 35, typically a diode. A first terminal of current sensor 50 is connected to the cathode of diode isolation device 35. A precision shunt 45 and resistor 47 are connected in series across a second terminal of current sensor 50, and the second output of the power supply. Similar to the main shunt device 40, precision shunt 45 may be an IGBT or other suitable electronic switching device. A third terminal of current sensor 50 is connected to a first terminal of resistor 52. Current sensor 50 measures the power supply's output current via first and second terminal connections. This current is proportional to the varying dynamic charge delivered to the load capacitor 82 after the main shunt 40 is enabled. Via its third terminal connection, the current sensor 50 outputs a voltage signal that is proportional to the current. That output is combined with the program voltage as described below to adjust the timing advance of the shunt control circuit 62. Current sensor 50 can consist of a toroidal transformer magnetically coupled to the first output of the power supply's output and appropriate circuitry to convert the induced current into a dc voltage output signal.

In typical embodiments, load module 80 is physically located outside of the enclosure for the power supply 20 and voltage regulator 10. Load module 80 includes a load capacitor 82 with resistors 72 and 74 connected across it in parallel. Load capacitor 82 and resistors 72 and 74 are connected to the output of the power supply 20 to supply charging current to the load capacitor. In the preferred embodiment, the supply output voltage is sensed in close proximity to the load capacitor in order to eliminate voltage errors present at the output of the power supply. A typical source of these errors is the voltage ripple induced on the supply's output cables from the output current ripple and the inductance of the cables. The common connection between resistors 72 and 74 is connected to the input of a precision, high speed, differential amplifier 78 that is used to eliminate electrical noise created by ground loops. Use of the precision differential amplifier 78 to sense load voltage remotely at the load capacitor 82 eliminates the voltage ripple seen on the output leads of the power supply. The sensing circuit reduces the effect of ground induced electrical noise and insures a highly frequency compensated response characteristic. While a voltage divider sensing circuit is used, the artisan will appreciate that other load sensing circuits known in the art may be used without deviating from the scope of the invention.

The output of differential amplifier 78 is connected in series to the first terminal of resistor 76. The second terminal of resistor 76 is connected to one input terminal of precision comparator 60 and the first terminal of resister 58. The second terminal of resister 58 is connected to the output of precision comparator 60. Comparator 60, with resistors 58 and 76, form a zero-detecting, inverting comparator with hysteresis. A digital-to-analog converter (DAC) 54 converts a digitally inputted program voltage (not shown in FIG. 1) into a corresponding analog voltage. Preferably, a stable, low impedance voltage reference source is provided internal to the power supply 20 for the dc program voltage input to DAC 54. Locating the DAC 54 in immediate proximity of the precision comparator 60 is preferred. While not required, the advantage of using a digital-to-analog converter is that an operating bandwidth greater than 500 kHz can be achieved. The analog voltage is outputted from DAC 54 and connected to the first terminal of resistor 56. The second terminal of resistor 56 is connected to the second terminal of resistor 52. Both the second terminal of resistor 56 and the second terminal of resistor 52 are connected to a second input terminal of precision comparator 60. The output of precision comparator 60 is connected to shunt control circuit 62. The output of shunt control circuit 62 is provided to the gates of IGBT main shunt 40 and IGBT precision shunt 45.

In operation, shunt control circuit 62 initially signals IGBT main shunt 40 to conduct, which shorts the first and second outputs of the power supply 20. The main shunt responds several orders of magnitude faster than the power supply 20 could in termination of supply output current. Isolation device 35 isolates the load circuit from the main shunt circuit. The shunt control circuit 62 signals IGBT precision shunt 45 to conduct at the same time it signals the IGBT main shunt 40 to conduct. Conduction of IGBT precision shunt 45 provides a circuit path for the charge stored in load capacitor 82 to discharge in a substantially linear fashion through resistor 47. Shunt control circuit 62 does not return IGBT precision shunt 45 to a non-conducting state until the hysteresis around the comparator 60 is satisfied. In this method, delaying the precision voltage comparison decision making until after power conversion is stopped mitigates the effect of electrical noise generated during power conversion.

The disclosed voltage regulator has demonstrated performance of less than 0.05 percent peak-to-peak voltage regulation and repeatability at pulse rates greater than 3,000 pulses per second.

Figures 2A, 2B, 2C, 2D, 2E, 2F, 2G, 2H, 2I:
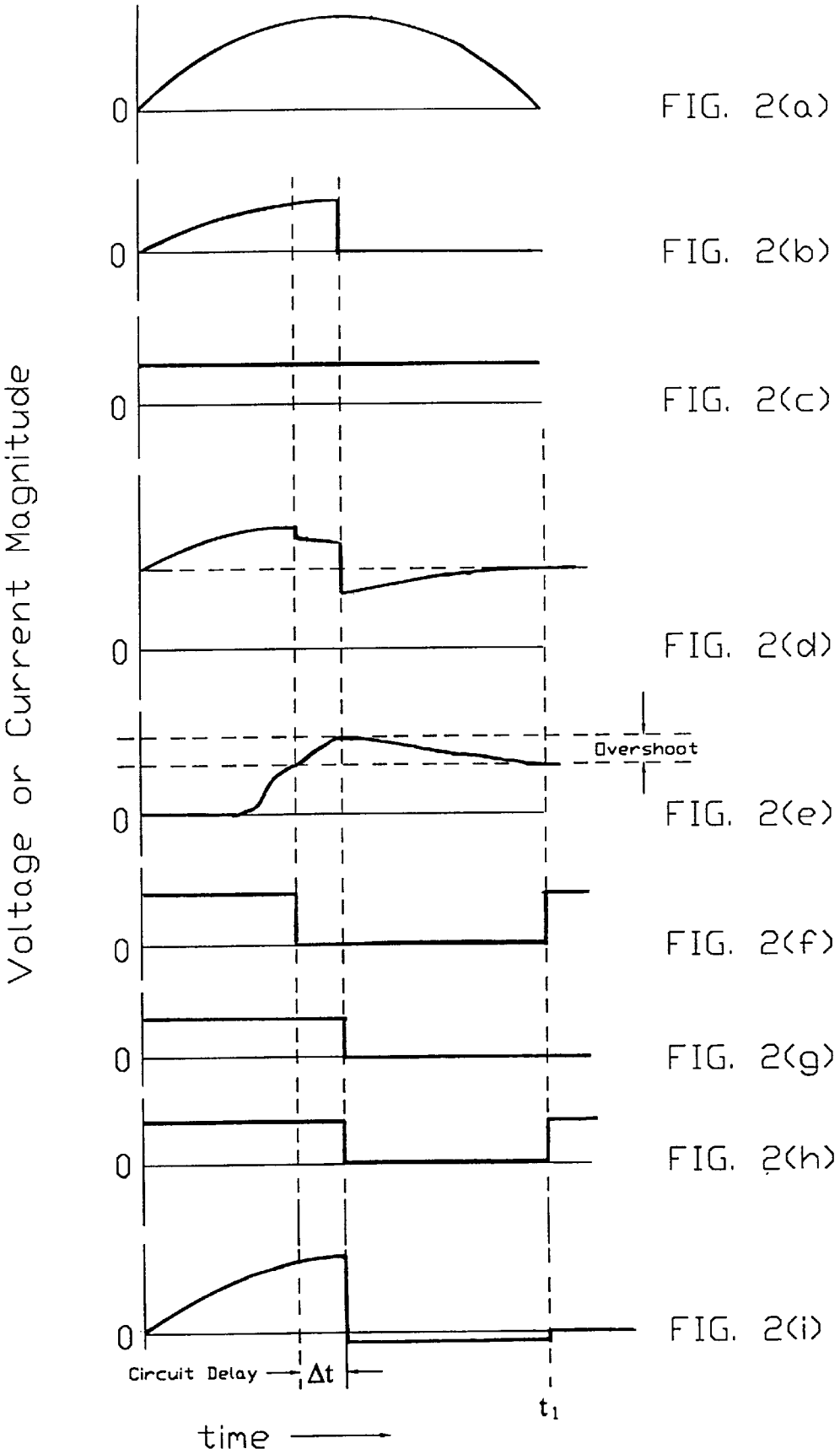
FIGS. 2(*a*) through 2(*i*) are timing diagrams illustrating signals in the precision voltage regulator of the present invention.

FIGS. 2(*a*) through 2(*i*) are timing diagrams illustrating signals in the precision voltage regulator of the present invention.

FIG. 2(*a*) shows the resonant output current pulse cycle that starts before the voltage on the load capacitor 82 is at the desired value. As described above, the current in the resonant tank circuit and transformer cannot be terminated in the middle of a switching cycle. Normally, the full resonant current pulse cycle is delivered to the load capacitor 82 and produces a significant overshoot. FIG. 2(*c*) represents the threshold voltage signal from the DAC 54 that is used for comparison with the modified feedback signal from the load capacitor as shown in FIG. 2(*d*). FIG. 2(*f*), which is the output signal from the comparator, shows that the decision to stop charging has been made at the beginning of the circuit delay period, $\Delta t$. FIG. 2(*i*) shows that the output current continues to flow in the load capacitor 82 after the decision to stop charging has been made. The delay arises from the cumulative effects of circuit delay. The length of the circuit delay is constant and the amount of voltage overshoot is proportional to the average of the instantaneous output current during the delay. The output current I is almost constant during the delay period and the voltage overshoot V can be closely approximated by $V=I(\Delta t/C)$, where C is the capacitance of the load capacitor.

The signal shown in FIG. 2(*b*), which is the output signal from the current sensor 50, is used to modify the threshold signal from the DAC 54. This will advance the decision to stop charging by a proportional amount depending on how much current is being delivered to the load capacitor 82. The advance compensates for the voltage rise shown in FIG. 2(*e*) during the circuit delay, reduces voltage overshoot and improves the repeatability from charge cycle to charge cycle.

FIG. 2(*g*), which is the voltage across shunt 40, shows that after the circuit delay, the low impedance shunt 40 is connected to the anode of the isolation diode 35 by a signal from the shunt control circuit 62. The low impedance shunt prevents the output current from flowing to the load capacitor 82 through the isolation diode 35 and gives the current in the secondary of the transformer 24 a low impedance path. The energy stored in the tank circuit and the transformer 24 are reflected back to the source 30. The threshold level is further modified with a small amount of hysteresis as shown in FIG. 2(*d*). At the same time that shunt 40 is connected, a second shunt 45 in series with a high impedance 47 is connected across the load capacitor 82 as shown by the voltage across shunt 45 in FIG. 2(*b*). The second shunt 45 precisely discharges the load capacitor 82 by an amount prescribed by the hysteresis added to the threshold level. The shunt 45 will remain on until the hysteresis around the comparator 60 is satisfied at time $t_1$.

The present invention may be embodied in other specific forms without departing from the spirit or essential attributes thereof. Accordingly, reference should be made to the appended claims, rather than to the foregoing specification, as indicating the scope of the invention.

What is claimed is:

1. A precision voltage regulator for a capacitor-charging power supply with a load capacitor comprising:

a main shunt device having first and second terminals connected across first and second outputs of the power supply;

an isolation device having first and second terminals, the first terminal of the isolation device connected to the first output of the power supply and first terminal of the main shunt device;

a current sensor connected in series with the first output of the power supply, to sense an output current of the power supply, the current sensor having an output signal proportional to the output current;

a precision shunt and load resistor connected in series across the terminals of the load capacitor;

a voltage sensor to sense the voltage across the load capacitor;

a precision differential amplifier having an input from the voltage sensor;

an analog program voltage;

a precision comparator with first input from the voltage sensor and second input comprising the combination of the analog program voltage and the output signal of the current sensor; and a shunt controller to enable main shunt device and precision shunt device substantially simultaneously, the precision shunt device remaining enabled until the hysteresis of the precision comparator is satisfied.

2. The precision voltage regulator of claim 1 wherein the current sensor is a toroidal transformer electromagnetically pled to the first output of the power supply and circuitry to convert current induced in the transformer into a signal proportional to the output current.

3. The precision voltage regulator of claim 1 wherein the voltage sensor comprises first and second resistors connected in series across the load capacitor with an output from the common terminals of first and second resistors.

4. The precision voltage regulator of claim 1 wherein the voltage sensor is connected in close proximity to the terminal of the load capacitor.

5. The precision voltage regulator of claim 1 wherein a digital-to-analog converter provides the analog program voltage from a digitally inputted program voltage.

6. The precision voltage regulator of claim 1 wherein the digital-to-analog converter is located in the immediate proximity of the comparator.

7. The precision voltage regulator of claim 1 wherein the second output of the power supply is connected to ground.

8. A method of precisely regulating the voltage across a load capacitor connected to a capacitor charging power supply comprising the steps of:

measuring a voltage at the load capacitor;

measuring an output current of the power supply;

establishing an analog program voltage;

inputting the measured voltage to a precision differential amplifier;

inputting the output of the precision differential amplifier to a precision comparator with hysteresis;

inputting the combination of the analog program voltage and output current to the precision comparator;

shunting the output of the power supply and the load capacitor at substantially the same time, while isolating the output and load capacitor circuits;

maintaining the shunt for the load capacitor until the hysteresis of the precision comparator is satisfied.

9. The method of claim 7 wherein the voltage of the load capacitor is measured in close proximity to the load capacitor.

10. The method of claim 7 comprising the further steps of establishing a digital program voltage, and converting the digital program voltage into an analog program signal.

* * * * *